United States Patent [19]

Ghusn

[11] Patent Number: 4,711,608

[45] Date of Patent: Dec. 8, 1987

[54] VEHICLE ACCESS CONTROL SYSTEM

[76] Inventor: Abdallah E. Ghusn, 2819 San Juan Blvd., Belmont, Calif. 94002

[21] Appl. No.: 749,225

[22] Filed: Jun. 27, 1985

[51] Int. Cl.[4] ..... E01F 13/00

[52] U.S. Cl. ..... 404/6; 404/7; 49/49

[58] Field of Search ..... 404/6, 7, 8; 49/35, 49/41, 49, 131

[56] References Cited

U.S. PATENT DOCUMENTS

| | | | |
|---|---|---|---|
| 3,783,558 | 1/1974 | Keator | 49/49 |
| 3,805,448 | 4/1974 | Carr et al. | 49/49 |
| 4,101,235 | 7/1978 | Nelson | 49/49 X |
| 4,325,651 | 4/1982 | Szegi | 404/6 |
| 4,332,503 | 6/1982 | Hurst, Jr. | 49/131 X |
| 4,354,771 | 10/1982 | Dickinson | 404/6 |
| 4,367,975 | 1/1983 | Tyers | 49/49 X |
| 4,490,068 | 12/1984 | Dickinson | 49/49 X |
| 4,554,695 | 11/1985 | Rowland | 404/6 X |

FOREIGN PATENT DOCUMENTS

| | | | |
|---|---|---|---|
| 2032983 | 5/1980 | United Kingdom | 49/131 |

*Primary Examiner*—Stephen J. Novosad
*Assistant Examiner*—Thomas J. Odar
*Attorney, Agent, or Firm*—David B. Harrison

[57] ABSTRACT

Apparatus and method of operation for controlling vehicular traffic entering or leaving a secured facility. The apparatus consists of a tire-puncturing spikes assembly, movable post assemblies, ditch/cover assemblies, fixed posts, a gate arm, and a safety hose & pressure switch assembly. Tire-puncturing spikes are mounted on a rotateable shaft imbedded in the roadway that will raise or lower the spikes in conjunction with the gate arm to control traffic. Movable posts can be raised or lowered to stop or permit traffic movement. Mechanically operated ditch covers can be opened to provide impassable traps for vehicles (or tanks). A gate arm operated in conjunction with the spikes will direct vehicles to stop before reaching raised spikes. A safety pressure switch and hose assembly is located immediately downstream of the spikes assembly and will automatically activate the entire apparatus into a "failsafe" mode if a vehicle passes over the hose while the spikes are in the raised position.

Fixed pipe barriers imbedded in concrete will channel vehicles over and prevent bypassing of the controllable system. A bullet-proof booth provides safety for the security guard. Integrated controls prevent unauthorized operation of the system, alert facility security in the event of danger, and automatically raise all barriers in the event of power failure or tampering. Mechanical power to operate all security barriers is provided from a compressed air system located away from the barriers, which includes emergency and backup sources of power that are activated automatically whenever the pressure in the primary source of power drops to predetermined levels.

18 Claims, 19 Drawing Figures

VEHICLE ACCESS CONTROL SYSTEM

BACKGROUND OF THE INVENTION

This invention relates to the control of vehicular traffic at secure facilities. More specifically the present invention relates to a failsafe method and apparatus for preventing unauthorized vehicles from entering the facility and potentially causing damage and injury to facility and personnel.

Heretofore, vehicular access to facilities typically was controlled by operating a barricade such as a sliding or swinging metal gate or a moveable barrier or door operated by a security guard. These gates, barriers and doors, by necessity of construction, cannot be made strong enough to prevent a vehicle from crashing through the gate and thereby approaching or reaching its target and causing damage or injury.

Furthermore, the barricade may be operated by any individual if the security guard is immobilized. Additionally, if the barricade is electrically operated and if power fails or is deliberately interrupted when the barricade is in the open position, it so remains and leaves the facility unprotected.

At some facilities permanent or semi-permanent traffic diverters such as large pipes have been laid horizontally on the roadway to force the traffic to weave between the diverters. The purpose of such devices is to slow traffic down and allow guards to attempt to stop the vehicle by whatever means they have available before the vehicle reaches its intended target.

Another method used at some facilities is the parking of moveable obstructions, such as loaded large dump trucks across the entrance which can be easily moved once the guard or operator is immobilized.

All of these prior security systems have proven to be either ineffective, costly, temporary, or have needlessly impeded and obstructed vehicular traffic to the facility. Furthermore, none of these sytems is failsafe or protected from unauthorized tampering.

SUMMARY OF THE INVENTION WITH OBJECTS

A general object of the invention is to provide a virtually impregnable and failsafe system for controlling vehicular traffic entering a secured facility in a manner which overcomes limitations and drawbacks of the prior art.

A more specific object of the invention is to prevent the use of a vehicle as a delivery means for delivering explosives, bombs, and the like, to the vicinity of a facility, such as embassy, consulate, military compound, sensitive laboratory, and other governmental buildings where they may then be exploded in order to wreak havoc, damage and destruction upon the facility and its occupants.

Another object of the present invention is to provide a security method which is especially applicable to facilities located in localities or countries where the overall security of the area is not under the control of the facility owner, such as embassies.

Another object of the invention is to provide a security system which will puncture all the tires of a vehicle in order to slow the vehicle and cause it to lose traction and steering ability so that it will thereby be prevented from reaching its target as well as from escaping.

Another object of the present invention is to provide a security system using movable pipe barriers that can be raised to prevent a vehicle from entering the facility.

Another object of the present invention is to provide a security system using tire traps that can be exposed to immobilize a vehicle when necessary.

Another object of the invention is to provide for the safety of the security guard while the system is operational by placing all control functions inside a bullet proof booth.

Another object of the invention is to provide for the security of the facility even if the security guard is immobilized by providing secret codes that must be entered into programmable controllers before the system can be operated.

Another object of the invention is to provide for the security of the facility when the guard is threatened, by automatically placing the entire apparatus in a failsafe mode and activating alarms in the security office and equipment room in the event of successive entries of wrong codes into the programmable controller.

Another object of the invention is to provide failsafe protection against deliberate or accidental power failure by requiring electric power in order to keep the barriers lowered and the facility accessible to vehicular traffic.

Another object of the invention is to protect against misoperation of the system, such as having the movable posts and the ditch cover barriers in the down positions and the spikes in the up position.

Another object of the invention is to provide the capability for the security guard to de-activate the entire apparatus in the failsafe mode at the sign of danger by operating one emergency switch only.

Another object of the invention is to require multiple magnetic cards for operating the programmable controllers.

The method of the invention includes providing permanent channeling, e.g. by fixed upright posts, for directing the path of vehicular traffic entering a protected facility over multiple controllable barriers; and operating the barriers independently or in unison to block access to the facility. Additionally, fixed posts may be located around the perimeter of the facility being protected to insure that vehicles can only enter the facility through the controlled access pathway. Sliding metal gates may be provided and operated at the perimeter line of the controlled access to control foot traffic, when necessary.

In the apparatus of the invention multiple independently controllable barriers are located in succession (sequence) and are combined with safety measures to insure the failsafe protection of the facility from unauthorized vehicles despite misoperation, guard immobilization, power failure, or tampering. These barriers comprise one or more of the following elements: spikes that will puncture all tires of an offending vehicle; movable posts that will physically damage and stop a vehicle attempting to proceed when the barriers are in the raised position; tire and wheel traps that will totally immobilize a vehicle attempting to proceed. The primary operation of the entire apparatus is controlled from a bullet-proof booth by a security guard who can see all barriers at all times. Additionally, emergency overrides are provided in the security office and the equipment room, located elsewhere on the facility, that can place the entire system in the failsafe mode and block all vehicular traffic to the facility. The apparatus also incorporates such additional safety measures as emergency and backup compressed air sources, dual programmable controllers requiring changeable magnetic cards and codes for operation, alarms, and automatic safety switches.

Additional objects, advantages and features of the invention will be even more apparent upon consideration of the following detailed description of a preferred embodiment presented in conjunction with the accompanying drawing. BRIEF DESCRIPTION OF THE DRAWINGS In the Drawings.

DESCRIPTION OF A PREFERRED EMBODIMENT

Figure 1:
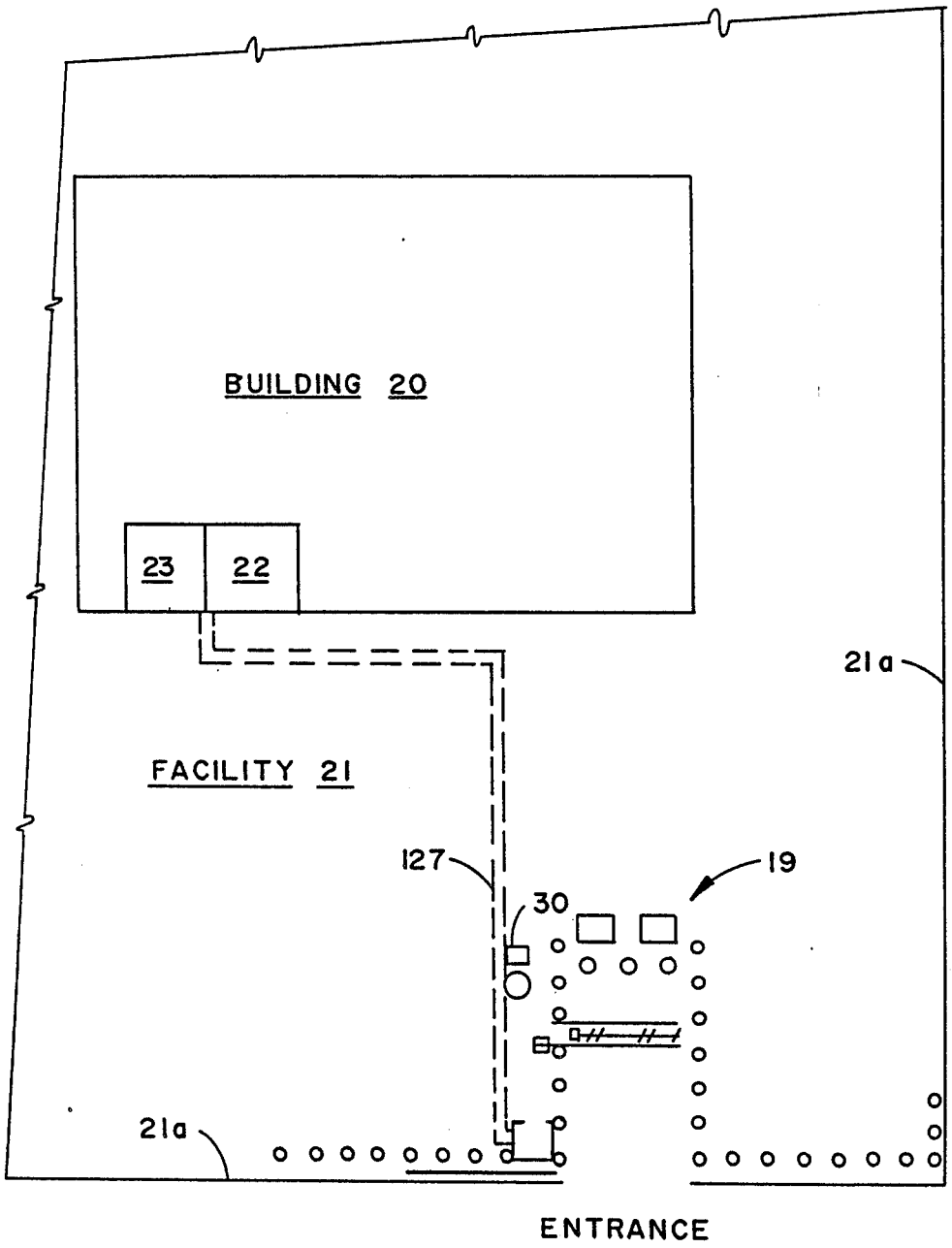
FIG. 1 is an overall plan view of a vehicle access control system embodying the principles of the present invention in relation to a facility being protected.

In the drawings FIG. 1 illustrates generally apparatus 19 incorporating the principles of the present invention being installed to protect a building 20 within a facility 21 from unauthorized vehicle entry. The facility 21 is surrounded by a perimeter barricade 21A to limit vehicular trafffic to one or more predetermined passageways. The exemplary building will be described as a diplomatic post such as embassy or consulate. It is also contemplated that the method and apparatus of the invention can be used for the protection of other buildings, singular or in groups, situated within a facility, from unauthorized vehicle entry. Further, the invention contemplates the facility being protected could also be a military installation, sensitive research laboratory, oil refinery, governmental building, or manufacturing facility. The apparatus of the invention is installed at every access to the facility and is controllable locally and/or remotely.

Figure 2:
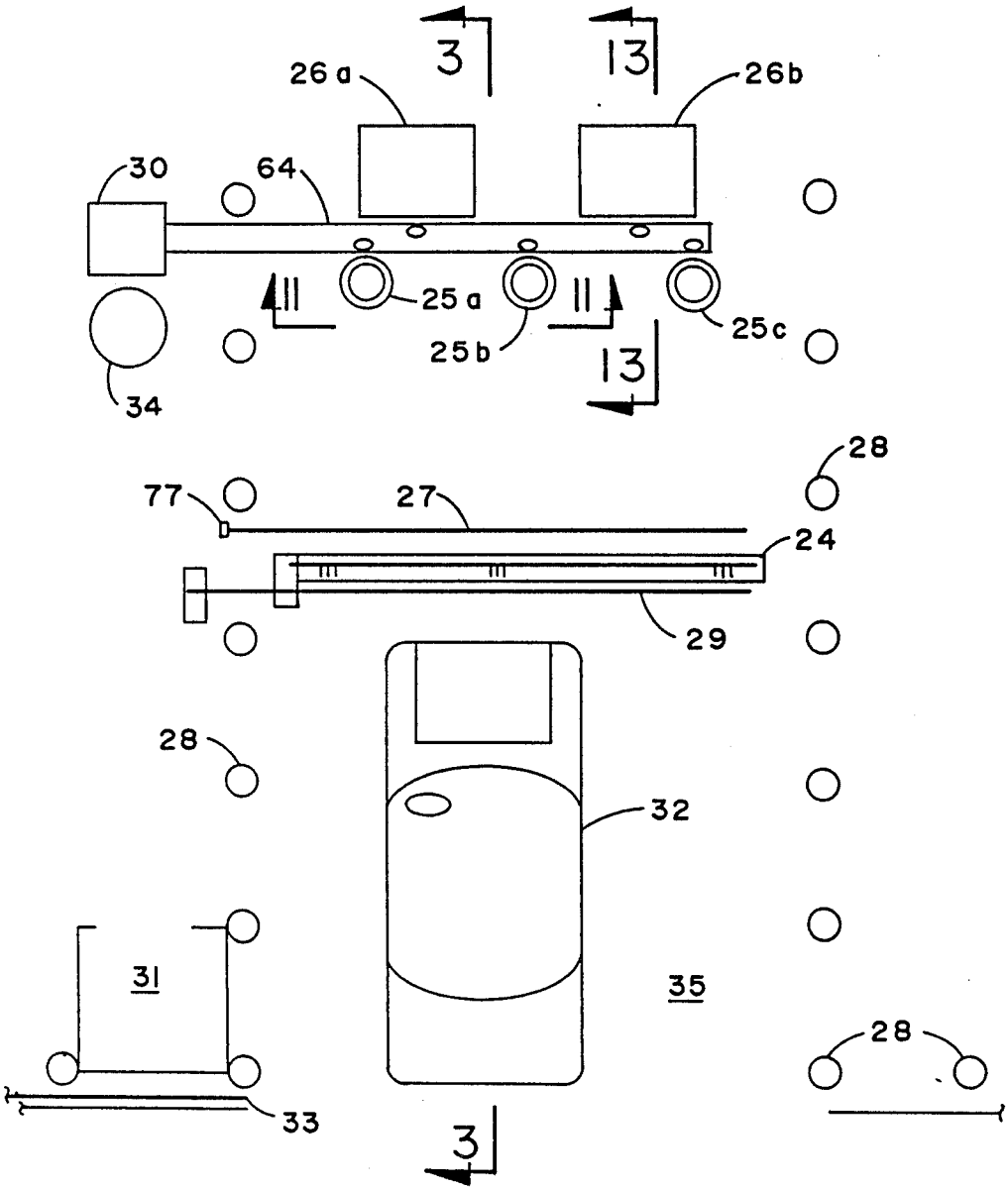
FIG. 2 is an overall plan view of the subject matter of FIG. 1 in an enlarged scale which shows the system and the interrelationship of its main components.
Figure 3:
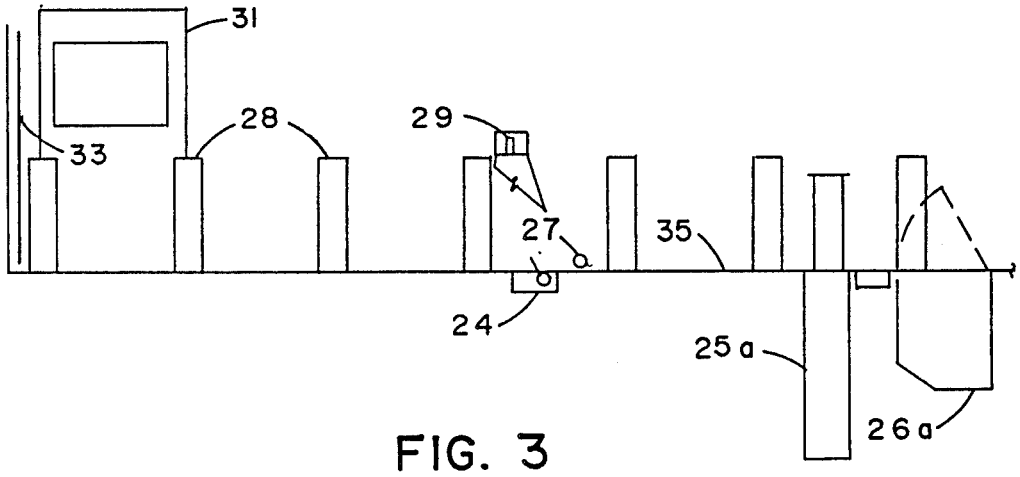
FIG. 3 is a cross-sectional view taken along line 3—3 in FIG. 2 and showing the inter-relationship of the main components of the system.

Apparatus 19 includes a spikes assembly 24, movable post assemblies 25, ditch/cover assemblies 26, pressure switch activating hose 27, fixed posts 28, gate arm 29, guard booth 31, and a valve box 30 as best shown in FIG. 2. An equipment room 23 is located in a nearby building and houses the air compressor 79 and receivers 80, 81 and other components necessary for the proper operation of the compressed air system. An alarm panel 124 in the equipment room 23 includes alarms, indicators and an emergency switch that deactivates the entire apparatus in a failsafe mode. A security office 22 located in the facility is equipped with a panel 123 that includes a master programmable controller (PC) 105, indicators and alarms and an emergency switch that deactivates the entire apparatus in a failsafe mode, as described later.

A "failsafe" mode as referred to herein is when all controllable barriers 24, 25, 26 are raised to block entrance to the facility through automatic safety or operational devices and remain only in such positions until corrective action is taken elsewhere than at the guard booth to restore the apparatus to a condition which permits vehicular traffic.

Figure 7:
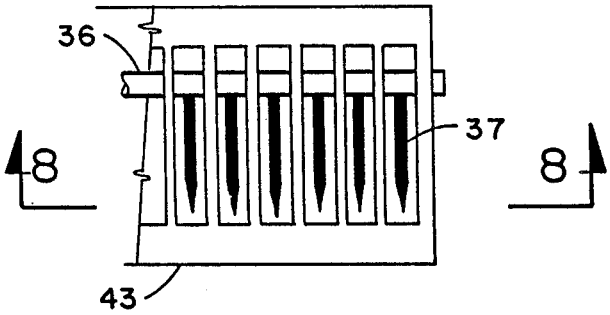
FIG. 7 is a fragmentary, partially broken-away, plan view to an enlarged scale of the spikes assembly shown in FIG. 4.
Figure 8:
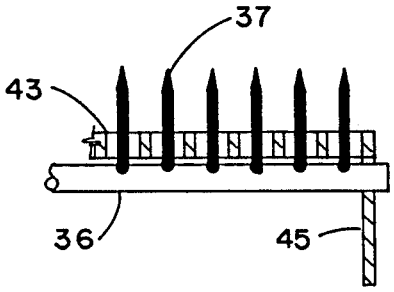
FIG. 8 is a cross-sectional view taken along line 8—8 in FIG. 7 showing the spikes in the raised position.
Figure 9:
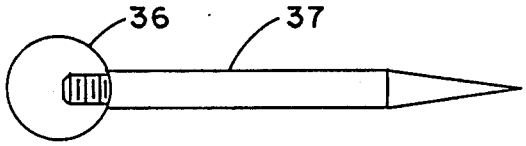
FIG. 9 is an elevational view to an enlarged scale of the spike component of the spikes assembly component of the system showing the method of attachment to the spikes shaft.
Figure 10:
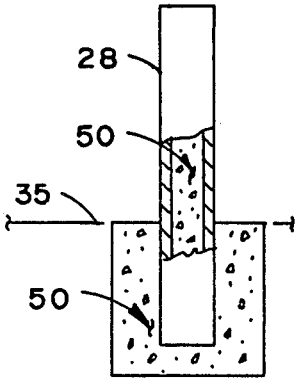
FIG. 10 is an elevational view, partially in axial section, of the fixed pipe barrier component of the system.

The spikes assembly 24 includes a spikes shaft 36 to which spikes 37 are attached and located just beneath a grating 43 on shaft supports 45. The spacing of the spikes along the shaft is about 2 inches and is identical to the spacing of the grating openings, as best shown in FIG. 7 and 8, so that when the shaft is rotated the spikes will protrude thorugh the grating 43 and above the roadway 35. The grating is bolted to channel supports 44 which are fastened to the concrete 50 by steel angles, not shown, so that the top of the grating is level with the roadway 35.

Figure 6:
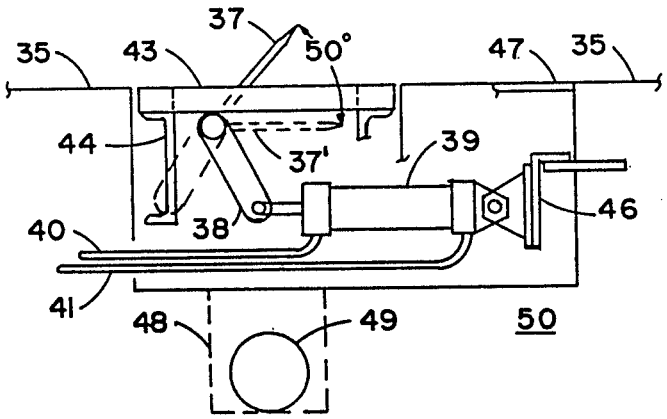
FIG. 6 is a cross-sectional view to an enlarged scale taken along line 6—6 in FIG. 4 showing the spikes assembly as installed in the roadway and with the spikes in the alternate raised and lowered positions.

An actuating arm 38 is attached to one end of shaft 36 and to actuating cylinder 39 which is trunion mounted to support 46 as shown in FIG. 6. The cylinder depression is protected by a heavy duty cover 47. The cylinder is actuated preferrably by compressed air (or hydraulic fluid) supplied through hoses 40 and 41 from the compressed air system shown in FIG. 14. Alternately, the spike shaft 36 may be actuated by an electric linear actuator in lieu of the pneumatic cylinder 39. The components are designed such that the spikes are positioned horizontally below the grating to allow vehicles to pass and when activated as a deterrent point above the horizontal at preferably 50 degrees and protrude about 4 inches above the grating in which position they will puncture the tires of any vehicle attempting to enter the facility, as shown in FIG. 6. The spacing of the spikes will insure that at least one spike will puncture every tire of the unauthorized vehicle.

Figure 12:
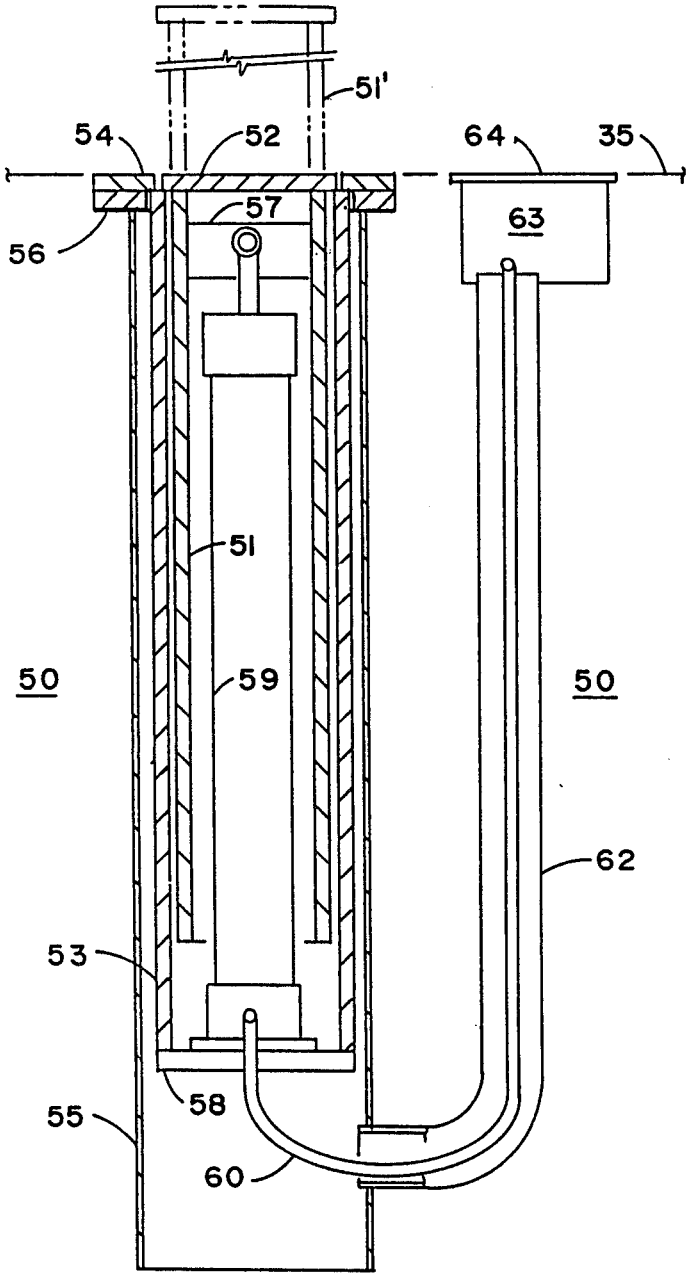
FIG. 12 is a cross-sectional view of the movable post assembly component of the system.

The movable posts barrier comprises several movable post assemblies 25, best shown in FIG. 2 and 12, spaced at approximately 54 inches on center across the vehicle path. The spacing of the movable post assemblies may be increased or decreased to suit site specific applications or different facility requirements. Each assembly consists of a caisson pipe 55 welded to flange 56 and permanently set in concrete 50. Such arrangement permits the exact alignment of the guide and movable posts for proper operation and reinforces the concrete for heavy traffic and prevents concrete sloughing which may interfere with the operation of the movable posts.

A guide post 53 welded to flange 54 is set in the caisson so that flange 54 is level with roadway and the flanges 54 and 56 are bolted together. A movable post 51 consisting of a heavy duty steel pipe welded to a cover plate 52 is set inside the guide post. A cylinder 59 is attached to the movable post at the cylinder rod plate 57 and to the guide post at the cylinder support plate 58. In the retracted position cover plate 52 is level with roadway. The cylinder 59 is actuated to extend the movable post approximately 30 inches above the roadway by compressed air supplied through hose 60, which enters the caisson through conduit pipe 62, from the compressed air system shown in FIG. 14. The movable post is retracted by releasing the air pressure to the cylinder and allowing the weight of the post to retract the cylinder.

Figure 11:
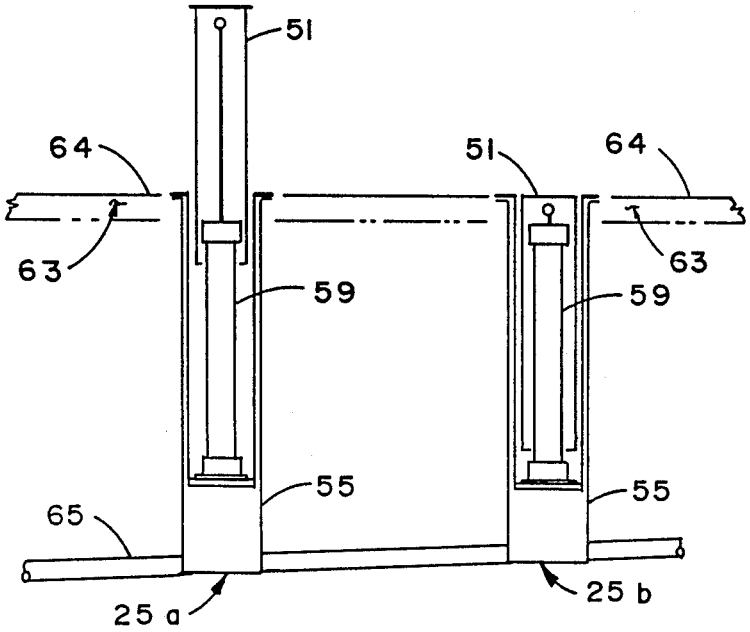
FIG. 11 is a vertical axial section view to an enlarged scale taken along line 11—11 in FIG. 2 and showing one movable post each in extended and retracted positions.

FIG. 11 shows two movable post assemblies 25, one having the movable post in the extended position 25*a* and one in the retracted position 25*b*. The movable posts, when raised, will physically damage and stop any vehicle that comes in contact with them. Additionally, a vehicle crashing into a movable post at substantial speed will be forced into a skewed position that will make it impossible for the vehicle to proceed even if the damage to the vehicle is not substantial. This will guard against a vehicle with reinforced front-end that may attempt to crash through the apparatus.

Figure 13:
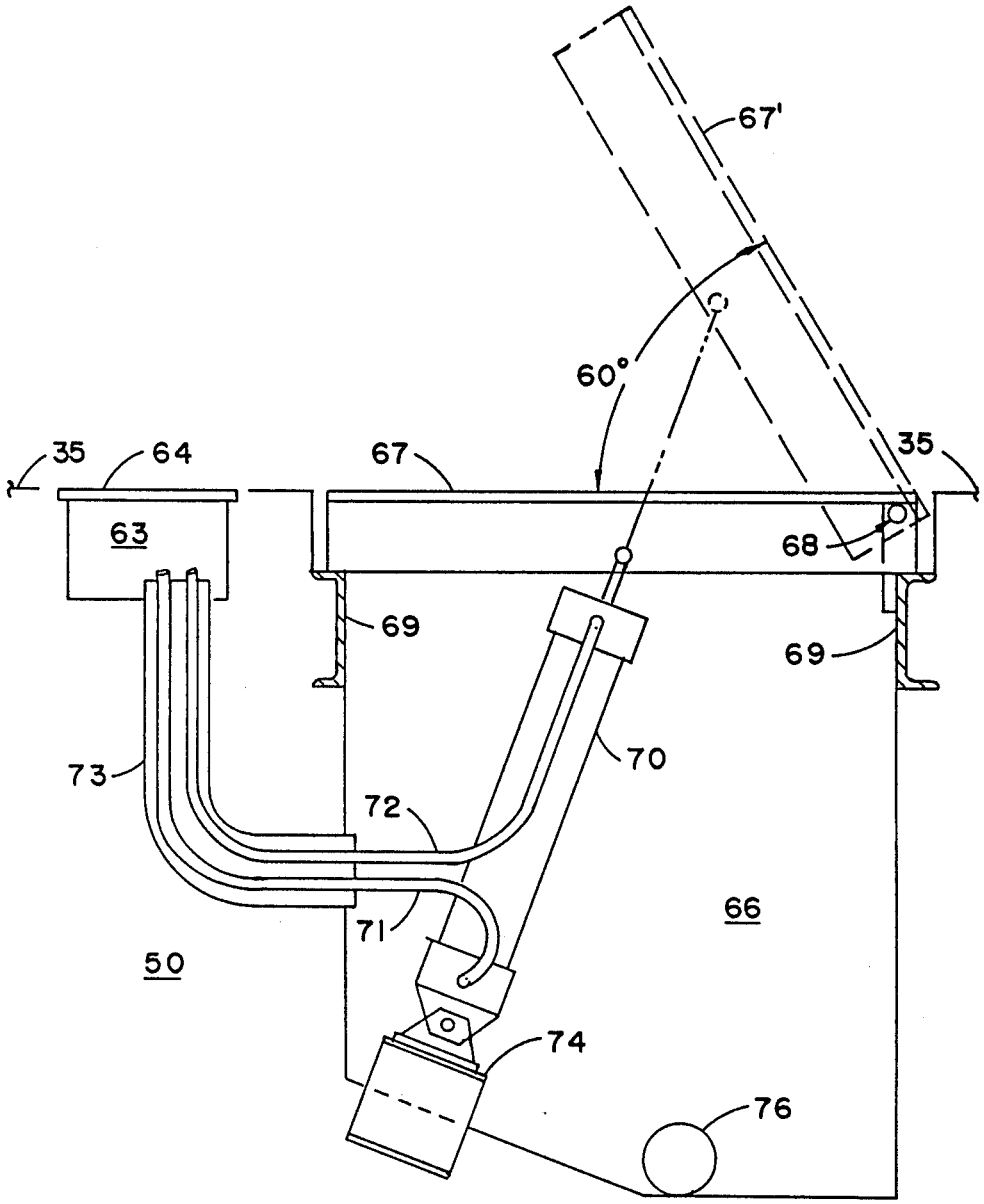
FIGS. 13, 13A are vertical axial section views, to an enlarged scale, of the ditch/cover assembly component of the system.

The ditch/cover barrier consists of several ditch-/cover assemblies 26, best shown in FIG. 2 and 13, spaced approximately 36 inches apart across the vehicle path. The spacing of the ditch/cover assemblies may be increased or decreased to suit site specific conditions and facility requirements. Furthermore, the ditch-/cover assemblies may be located upstream or downstream of the movable post assemblies 25.

Each assembly consists of a ditch 66 surrounded by concrete 50 and provided with a structural cover 67 that is normally level with the roadway 35 to allow vehicular traffic. The cover is supported by steel channels 69 imbedded in the concrete 50. A cylinder 70 is set in the ditch and attached to the cover and is trunion mounted to support 74 imbedded in the concrete. The cylinder is extended or retracted by compressed air supplied through hoses 71 and 72 that enter the ditch through conduit pipe 73. The cylinder when extended will hinge the cover 67 on pin 68 at about 60 degrees above the horizontal, position 67' in FIG. 13, to create a trap for vehicle tires thus preventing the vehicle from proceeding.

Figure 13A:
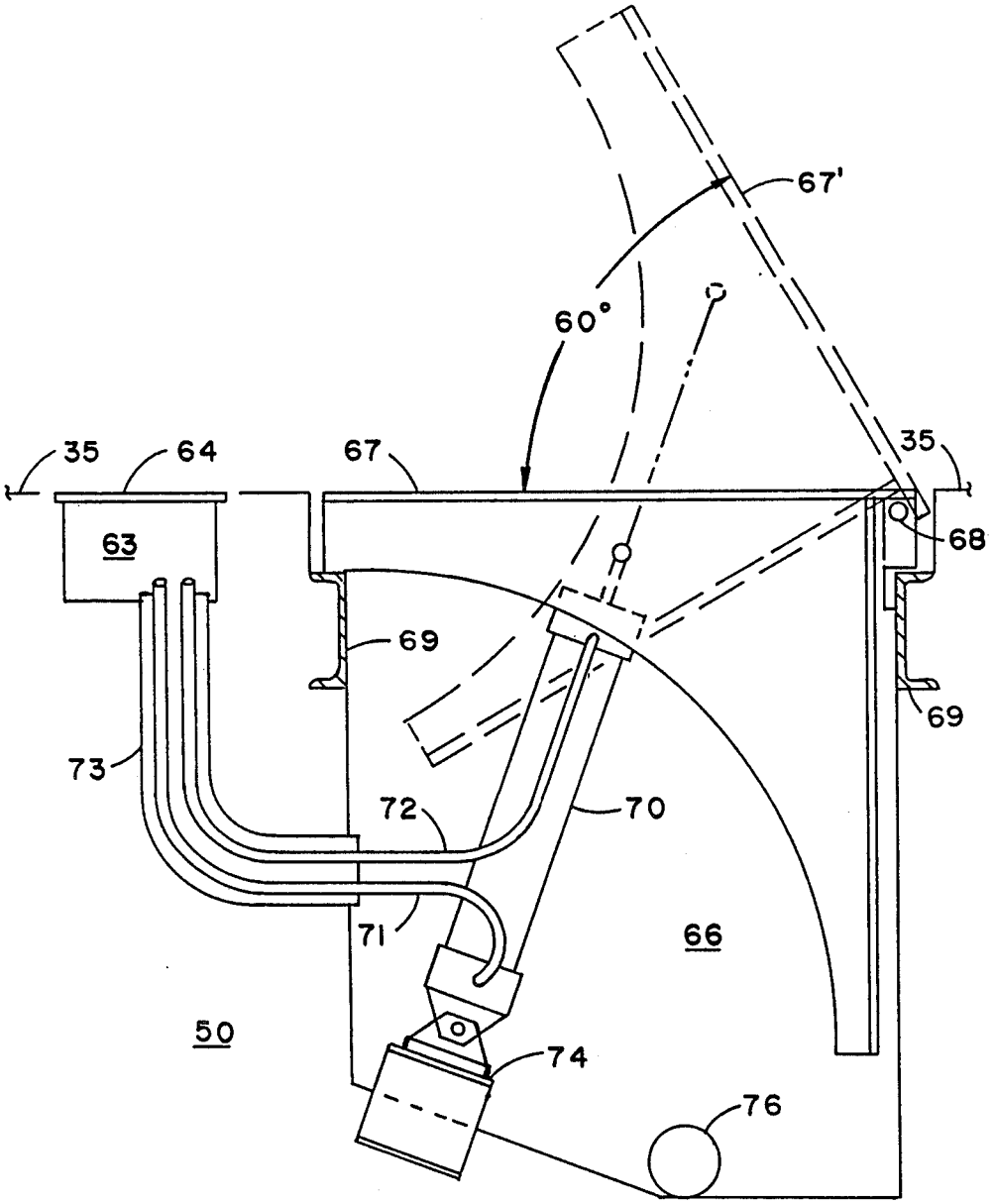

The ditch cover 67 may incorporate a secondary plate attached solidly thereto at 90 degrees near the hinge pin 68, as shown in FIG. 13A. The plate is properly reinforced and slightly narrower than the width of the ditch, so that if a vehicle or tank pushes cover 67 to a vertical position, the secondary plate will come in contact with a lower surface of the vehicle tire or tank tread and will cause the weight of the vehicle or tank to act against the forward motion of the vehicle or tank. The forward motion will tend to lift the vehicle or tank off the ground.

The fixed post barriers consist of a plurality of heavy duty concrete filled steel pipes 28 set in concrete 50 at about 4 feet centers on both sides of the entry way to channel the traffic across and prevent bypassing the controllable barriers 24, 25 and 26. Fixed posts 28 may also be placed around the entire perimeter of the facility to insure that vehicles can only enter the facility through the controlled access pathway. Sliding metal gates 33 are located at the facility perimeter line of the controlled access to control pedestrian traffic when necessary.

The guard booth 31 is a bullet-proof operating station from which the security guard exercises primary control over the entire apparatus. The booth 31 is constructed of heavy duty steel plate and provided with bullet-proof glass windows to facilitate safe observation.

Figure 4:
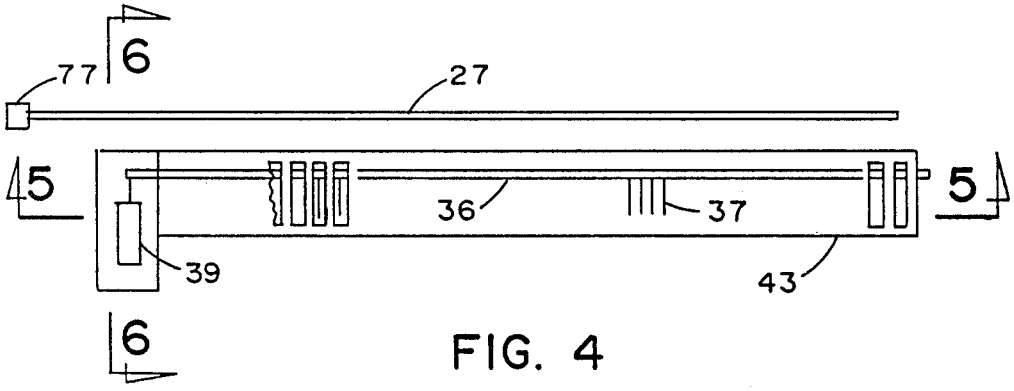
FIG. 4 is a plan view to an enlarged scale of the spikes assembly and safety pressure switch/hose components of the system.
Figure 5:
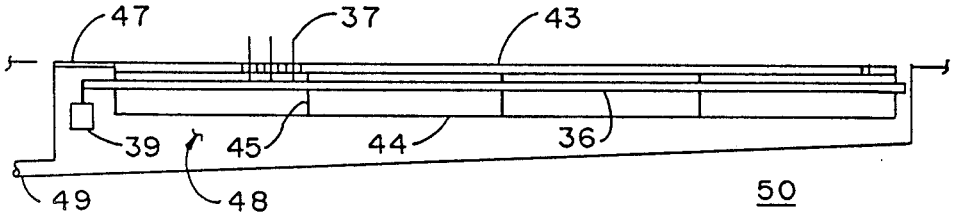
FIG. 5 is a cross-sectional view taken along line 5—5 in FIG.4.

The hose/pressure switch safety assembly consists of a liquid-filled hose 27 anchored to the roadway immediately downstream and adjacent to the spikes assembly 24 and connected to an electrical pressure switch 77 as shown in FIG. 4. This assembly provides an automatic safety control, as described later.

Figure 14:
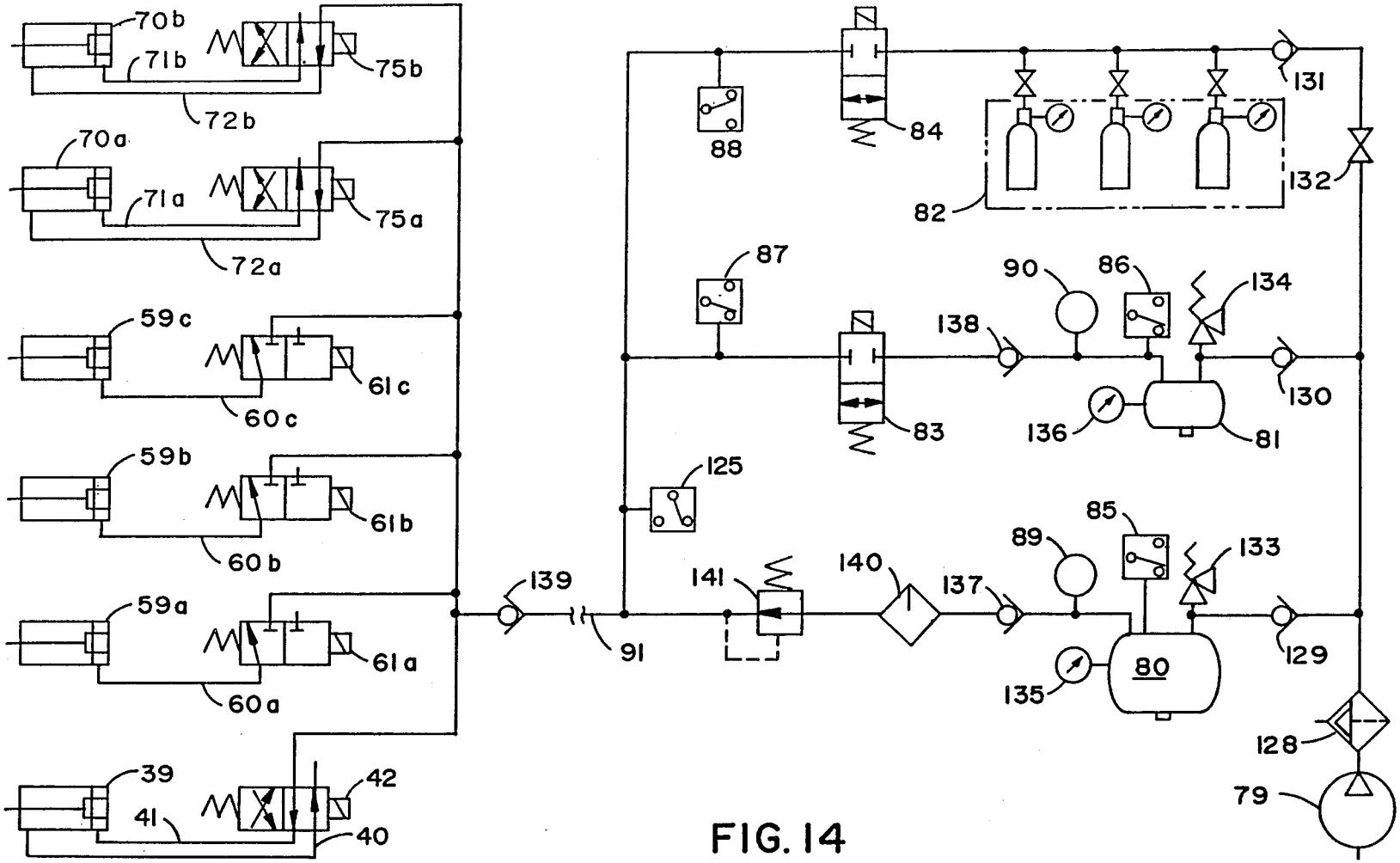
FIG. 14 is a schematic diagram of the compressed air operating and control system component of the system.

FIG. 14 illustrates the main components of the compressed air system utilized in operating the security barriers. It also is contemplated that a hydraulic system may be used to operate the security barriers. An air compressor 79 is located in equipment room 23 and automatically maintains predetermined pressure levels in the normal use air receiver 80 and the emergency air receiver 81. Each air receiver is equipped with a pressure switch 85 and 86 that will sound alarms 113 and 116 and energize flashing lights 114, 115, 117 and 118 in the equipment room 23 and the security office 22 if the air pressures fall below predetermined levels.

Additionally, pressure transmitters 89 and 90 continuously indicate the pressures in the air receivers at the guard booth 31 on pressure indicators 92 and 93 and in the security office 22 on pressure indicators 94 and 95. A filter separator 128 and check valves 129, 130, 131 are in the air line extending from the compressor 79 to the air receivers 80, 81 and 82. A hand valve 132 is provided in the line to the reserve air bottles 82 to enable them to be removed for recharge remotely to the facility. Each air receiver 80, 81 is provided with a pressure relief valve 133, 134, and local presure indicators 135, 136. Two check valves 137, 138 are respectively provided downstream from the receivers 80, 81 in order to prevent air from one backing into the other. A check valve 139 located close to the valve box 30 is provided in the main line 91 to hold pressure in the barricade system in case of a line rupture upstream from the valve 139. An emergency air supply reservoir (not shown) may conveniently be located at the valve box 30 to cover emergency situations where the air supply line 91 may become ruptured. A lubricator 140 is provided in the normal use air system leading from the receiver 80 in order to provide lubrication for the valves and cylinders. A pressure regulator 141 in the same main line regulates normal operating pressure and thereby controls the speed of barricade operation.

During normal operation air is drawn from receiver 80 through pipe 91 and the directional control valves 42, 61 and 75 to operate the respective security barriers. If the pressure in receiver 80 drops below a predetermined level, pressure switch 87 causes valve 83 to open thus providing an emergency air source to operate the security apparatus. If the pressure in the emergency air receiver 81 drops below another predetermined level, pressure switch 88 causes valve 84 to open thus providing backup air supply from air bottles 82, which may be charged by the compressor or at an outside facility.

Valves 83 and 84 can also be opened from the equipment room by disengaging switches 120 and 121 respectively. Valves 83 and 84 are solenoid operated, spring loaded, 2-way, 2-position valves that are normally open. The valves are maintained closed by applying electric current to the solenoids and will open if the electric current is interrupted.

Valves 42, 61 and 75 are solenoid operated, spring loaded, 3-way, 2-position valves that are normally open and maintained closed by applying electric current to the solenoids. These valves will open if the electric current is interrupted thus admitting the compressed air to the cylinders to activate the security barriers to block access of vehicles to the facility.

If the air pressure continues to drop to a predetermined minimum level, pressure switch 125 will close and shunt the supply electric current around ground-fault-circuit-interrupter (GFCI) 119 simulating a power failure and activating the entire apparatus into the fail-safe mode.

Figure 15:
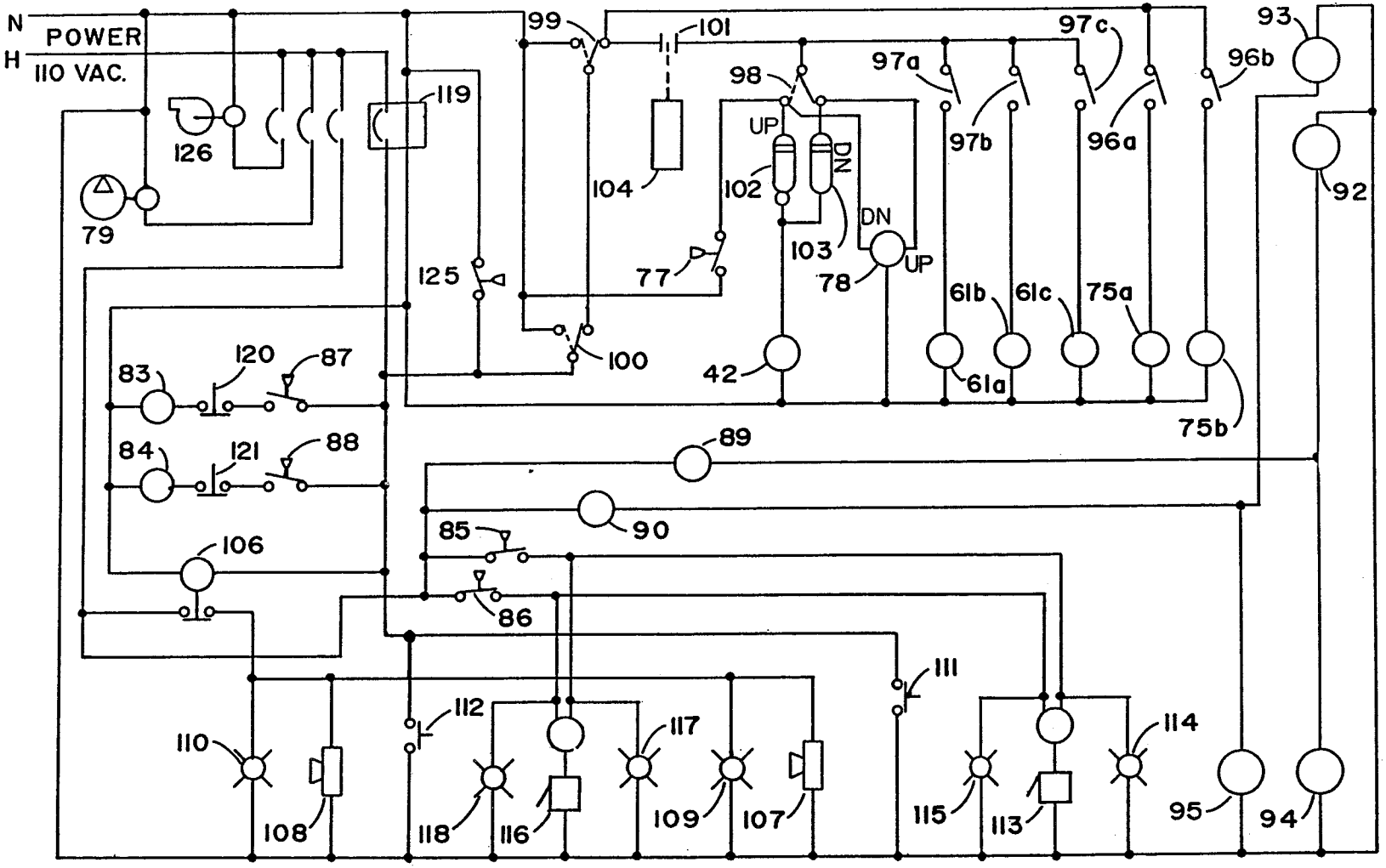
FIG. 15 is a schematic diagram of the electrical control, alarm and safety system component of the system.
Figure 16:
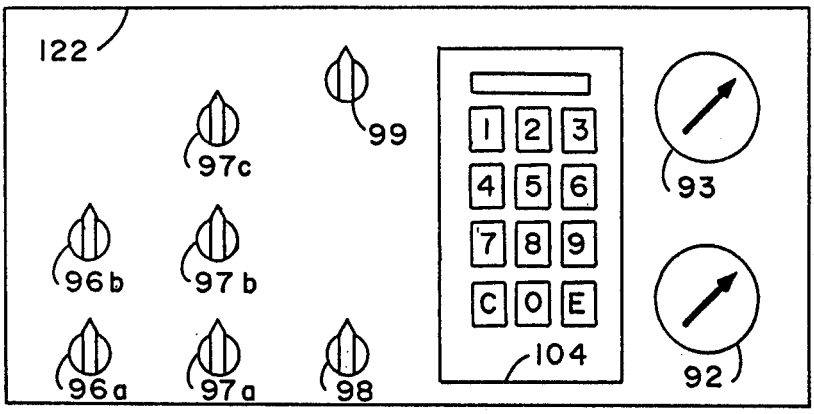
FIG. 16 is a plan view of the primary operating and control panel of the system.
Figure 17:
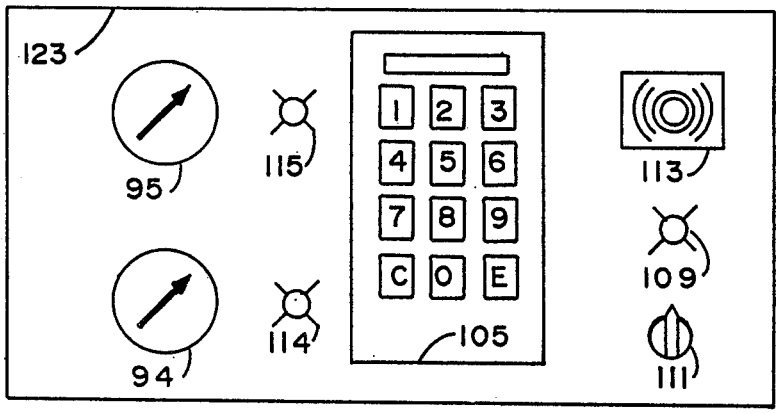
FIG. 17 is a plan view of the main safety, control and alarm panel of the system.
Figure 18:
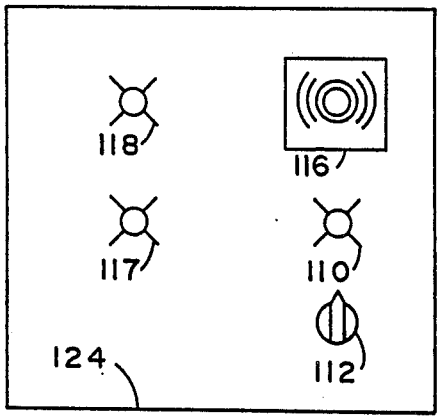
FIG. 18 is a plan view of the auxiliary safety and alarm panel of the system.

The entire system 19 is controlled and operated from the guard booth 31 and is provided with emergency over-rides located in the equipment room 23 and the security office 22 as shown in FIG. 15.

Power to all solenoids is supplied through the GFCI breaker 119 located in the equipment room. Power then passes through a spring-loaded 3-way switch 100 located in the valve box 30 and maintained closed by the valve box cover, an emergency 3-way switch 99 and a set of contacts 101 both located in the control panel 122 before feeding the security system operating switches. A master PC 105 located in the security office and a slave PC 104 located in control panel 122 control the contact points 101.

A magnetic card, not shown, must be inserted and maintained in the slave PC 104 and the appropriate code entered in order to close the contacts 101 and provide power to the operating switches. Each guard will be issued an individual magnetic card and assigned a code which can be changed only at the master PC 105.

Power to all alarms, pressure indicators, the air compressor 79 and the sump pump 126 is supplied from separate circuit breakers, as best shown in FIG. 15. Alarm solenoid switch 106 is normally closed and maintained open by the solenoid which is supplied with electricity from the GFCI 119. If the GFCI 119 trips under conditions outlined herein, switch 106 will close completing the electrical circuit to sound the alarms.

Air pipes and electric wires from the equipment room and security office to the security barriers and guard booth are routed underground 127 as shown in FIG. 1. Air hoses from the valve box 30 to the hose conduit pipes are routed in channel 63 imbedded in the roadway and protected by heavy duty cover 64.

The entire apparatus is controlled and operated from control panel 122 by a security guard from inside a bullet-proof booth and having full view of the entry way and all the security barriers. Vehicle entry into the facility is guided by fixed posts 28 and directed towards the security barriers 24, 25 and 26. The guard will have one or more of the security barriers in the "up" or "protective" position at all times.

When a vehicle 32 approaches the facility the driver must stop before the gate arm 29, as best shown in FIG. 2. If the guard recognizes the vehicle and/or driver as "authorized" entry he will raise the gate arm 29 and lower the spikes 37 by disengaging switch 98 which activates the gate arm actuator 78 and de-energizes solenoid valve 42, and will lower the desired movable posts and ditch covers by disengaging the respective switches 96 and 97. This procedure enables the vehicle to proceed onto the facility. The guard then engages the switches thus securing the facility again.

The circuit between switch 98 and solenoid valve 42 incorporates time delay devices 102 and 103 to integrate the operation of the spikes and the gate arm and prevent accidental tire puncturing. Device 102 will de-energize solenoid valve 42 following a definite intentional time delay after its input is energized to insure that the gate arm 29 is almost completely down before the spikes are raised. Device 103 will energize the solenoid valve 42 following a definite intentional time delay after its input is energized to insure that the spikes remain raised until the gate arm is partially raised. The lengths of time delay for devices 102 and 103 are selected in conjunction with the gate arm actuator operating characteristics.

If the guard does not recognize the driver of the vehicle he removes his magnetic card from the PC 104 and leaves the booth to check the driver and/or inspect papers or permits. This action will automatically raise, or prevent the lowering of, barriers 24 and 25 thus preventing the vehicle from proceeding.

After satisfactory inspection of the vehicle the guard must return to the booth, insert the magnetic card in PC 104 and enter his assigned code before the barriers can be lowered. It is also contemplated that lights may be added in the security office to flash "caution" any time the magnetic card is removed from the PC 104.

If a person overpowers the security guard and removes his magnetic card, such person cannot use the card since such person does not know the code. If a wrong code is entered into PC 104 more than once in sequence such action will automatically de-energize PC 104 thus maintaining contacts 101 open and barriers 24 and 25 raised and will sound alarms 107 and 108 and energize lights 109 and 110 in the security office and equipment room. This procedure protects against unauthorized persons attempting to activate the system through trial and error code entries into PC 104. The system can then be reactivated only after PC 104 is re-energized through the proper entry on PC 105.

The system is also designed to minimize danger to the security guard. Entry of the wrong code into PC 104 will cause the display of "please wait" on the PC readout panel. After a few seconds the display will read "enter second code". If another wrong code is entered into the PC 104 the display will again read "please wait" while simultaneously activating the failsafe mode and the alarms. This feature will allow facility security to rush reinforcement to the guard station.

If the guard in the booth judges a vehicle and driver to be dangerous, he disengages emergency switch 99 which trips the GFCI 119 thus cutting power to the solenoid valves and activating all security barriers to the failsafe mode, sounds alarms 107 and 108 and energizes associated lights 109 and 110 in the security office and equipment room, and opens emergency and backup air valves 83 and 84 insuring adequate supply of compressed air to secure the facility quickly. The same effect is produced if (1) power to all the solenoids interrupted, (2) the valve box cover is opened deactivating switch 100, (3) a vehicle passes over the spikes 37 when in the raised position causing switch 77 to shunt the GFCI 119, (4) opening either switch 111 or 112 in the security office or equipment room respectively, or (5) compressed air system pressure falls to the minimum predetermined level thus closing switch 125.

The apparatus may be restored to normal operating condition only by resetting the GFCI 119 in the equipment room and only after the respective emergency action taken above is restored to normal condition.

The entire apparatus is designed and components are selected so they are not affected by flooding. However, a sump 34 is provided to collect water from the cavities of barriers 24, 25 and 26 through drain channel 48 and drain pipes 49, 65 and 76. The sump is equipped a float-operated submersible pump 126 that will discharge the collected water into the public drainage system or away from the apparatus.

It is apparent from the foregoing that there has been provided a new and improved apparatus and method of operation by which a facility can be secured and protected against unauthorized vehicle entry by means of a compact, relatively inexpensive, tamper-proof, and fail-safe system. Furthermore, the method and apparatus of the invention make the installation permanent, effective and flexible to accommodate different facilities as well as protecting the security guard against unwarranted danger.

While the foregoing embodiment is at present considered to be preferred it will be understood that numerous variations and modifications may be made therein by those skilled in the art, and it is intended to cover in the appended claims all such variations and modifications as fall within the true spirit and scope of the invention.

I claim:

1. A failsafe system for protecting a facility from unauthorized entry by a road vehicle, the system including:

an enclosing vehicle-impervious barrier for surrounding the perimeter of the facility, at least one controlled entry and exit vehicle lane for road vehicles extending through the barrier at a predetermined location, the lane including:

plural spaced apart fixed lane delineation means for defining the right and left boundaries of the lane through the barricade, the lane delineation means being reinforced, slightly wider than the widest of road vehicles authorized access to the facility and of a height above a road surface of the lane for effectively blocking and preventing travel of a road vehicle except over the surface of the lane between the right and left boundaries thereof, the delineation means including physical obstructions for constraining vehicular traffic to a predetermined passageway adjacent said facility, a series of operably releasable reinforced barricades placed in the lane, each barricade having an obstruction position effective to block vehicle movement therebeyond, the barricades being arranged successively in the lane, so that if a first barricade in its obstruction position is passed by an unauthorized vehicle, a second barricade in its obstruction position remains in its path, and if the second barricade in its obstruction position is passed, a third barricade in its obstruction position remains in its path, a series of prime movers, each prime mover being connected to operate a said barricade so that it may be released and withdrawn under positive control from its obstruction position;

the system further including integrated controller means for controlling the operations of the prime movers so that the barricades may be emplaced in their obstruction positions and may be released from their obstruction positions to enable a single authorized vehicle at a time to pass said barricades, the integrated controller means being adapted to emplace and maintain the barricades in their respective obstruction positions in a failsafe mode in the absence of a control signal generated to permit passage over the lane by an authorized vehicle; and, a bullet-proof observation booth that houses the primary controls for the entire security system and from which an operator may see all vehicular traffic approaching and entering said lane and from which said single controller means may be controlled.

2. The system set forth in claim 1 further comprising alarms, emergency and safety switches that alert a central security area of the facility to potential danger while simultaneously preventing any vehicle from entering the facility.

3. The system set forth in claim 1 wherein said fixed lane delineation means comprise fixed pipes imbedded in concrete.

4. The system set forth in claim 1 further comprising local and remote operator actuated controls and automatic safety controls, any of which can independently place the entire system in a failsafe mode and block vehicle access to the facility.

5. The system set forth in claim 1 wherein one or more of said barricades comprises a plurality of raisable gang operated spaced apart tire puncturing spikes in the lane adapted for puncturing all the tires of a vehicle that does not stop when said spikes are raised.

6. The system set forth in claim 1 wherein at least one of said barricades comprises a plurality of movable reinforced posts across the vehicle path that may be raised to physically stop a vehicle that is not authorized to proceed, said posts for crushing the vehicle and forcing a change in its alignment causing it to jam into the fixed and movable posts.

7. The system set forth in claim 1 wherein at least one of said barricades includes a plurality of transverse ditches in said lane and cover plates that are raised in the obstruction position to expose the ditches for trapping the tires of the vehicle and preventing it from proceeding.

8. The system set forth in claim 7 in which the cover plates have secondary plates attached thereto and substantially perpendicular therewith near the hinge pin and pointing in the direction from which vehicle is approaching, the combination of said plates and said secondary plates creating a barrier, part of which blocks the forward motion of the vehicle and part of which comes in contact with the underside of the vehicle tires or the tank treads causing the weight of the vehicle or tank to act against and prevent the forward motion of said vehicle or tank.

9. The system set forth in claim 1 further comprising a liquid-filled hose disposed across the lane adjacent the first barricade that senses the weight of a vehicle and automatic control means communicating with the controller means for automatically operating said prime movers to move said barricades to their obstruction positions to block vehicle entry in the event a vehicle crosses over said hose unless said automatic control means is first overriden and disabled by said control signal.

10. The system set forth in claim 1 further comprising a plurality of programmable barricade controllers, there being at least one controller in said observation booth, and a like plurality of individual magnetic control cards each being assigned to an operator located at each said controller, each said controller being responsive to a magnetic card.

11. The system set forth in claim 10 in which a controller is adapted for receiving an operation code manually insertable therein by an operator, and wherein a correct code must be entered into the programmable controller after the magnetic card is inserted to remove the barricades and permit a vehicle to pass over said lane.

12. The system set forth in claim 10 adapted for automatically placing the entire security system in its failsafe mode and for alerting central facility security in the event a wrong code is entered into the programmable controller in the observation booth more than once in succession.

13. The system set forth in claim 10 further comprising remote over-ride emergency safety switches that allow central facility security operators to emplace all said barricades.

14. The system set forth in claim 1 further including means for sensing irregularities in vacility electric power supply and for thereupon tripping a ground-fault-circuit-interrupter thereby automatically emplacing all said barricades.

15. The system set forth in claim 14 further comprising air supply for operatively emplacing said barricades and normally open and solenoid maintained control valves for automatically opening in case of electric power failure.

16. The system set forth in claim 1 further comprising an emergency signalling means in said bullet-proof guard booth for sounding alarms while simultaneously activating all security systems to emplace said barricades and thereby prevent vehicles from entering or passing along said passageway.

17. The system set forth in claim 15 further comprising backup sources of compressed air actuating power for all said barricades in the event of irregularities in facility electric power by providing normally open emergency and backup compressed air supply valves that require facility electric power in order to remain closed and which open automatically if facilities electric power is interrupted.

18. The system set forth in claim 15 further comprising reserve air supply means including a plurality of removable compressed air bottles that may be removed, recharged and connected to the compressed air system to provide the actuating power for operating the security barricades, said air supply means being available to operate said system in the event of an extended power failure.

* * * * *